US012466692B2

(12) United States Patent
Fujiki et al.

(10) Patent No.: US 12,466,692 B2
(45) Date of Patent: Nov. 11, 2025

(54) FILAMENT WINDING METHOD AND FILAMENT WINDING APPARATUS

(71) Applicant: HONDA MOTOR CO., LTD., Tokyo (JP)

(72) Inventors: Koei Fujiki, Wako (JP); Kosuke Tatsushima, Wako (JP)

(73) Assignee: Honda Motor Co., Ltd., Tokyo (JP)

( * ) Notice: Subject to any disclaimer, the term of this patent is extended or adjusted under 35 U.S.C. 154(b) by 342 days.

(21) Appl. No.: 17/829,447

(22) Filed: Jun. 1, 2022

(65) Prior Publication Data

US 2022/0396452 A1 Dec. 15, 2022

(30) Foreign Application Priority Data

Jun. 10, 2021 (JP) ..... 2021-097340

(51) Int. Cl.
*B65H 59/26* (2006.01)
*B65H 59/38* (2006.01)

(52) U.S. Cl.
CPC ..... *B65H 59/26* (2013.01); *B65H 59/38* (2013.01); *B65H 2553/00* (2013.01)

(58) Field of Classification Search
CPC ..... B65H 21/20; B65H 59/26; B65H 59/36; B65H 59/38; B65H 59/384; B65H 59/387; B65H 2553/00; B65H 51/20; B65H 59/388; B29C 53/8041; B29C 53/8016
USPC ..... 242/410
See application file for complete search history.

(56) References Cited

U.S. PATENT DOCUMENTS 4,398,677 A * 8/1983 Henrich ..... B65H 67/04 242/413.5
5,957,402 A * 9/1999 McEathron ..... B65H 54/026 242/413.3
8,955,787 B2 * 2/2015 Tanigawa ..... B65H 59/387 242/439.6

(Continued)

FOREIGN PATENT DOCUMENTS

CN 104593935 A * 5/2015 ..... B65H 59/36
DE 10003184 A1 * 8/2001 ..... B65H 51/12

(Continued)

OTHER PUBLICATIONS

Office Action dated Jul. 2, 2024 issued in the corresponding Japanese Patent Application No. 2021-097340 with the English machine translation thereof.

(Continued)

*Primary Examiner* — Anna M Momper
*Assistant Examiner* — Henrix Soto
(74) *Attorney, Agent, or Firm* — Carrier, Shende & Associates P.C.; Joseph P. Carrier; Fulchand P. Shende

(57) ABSTRACT

A filament winding apparatus includes a bobbin driving unit, a winding device, and a tension applying device. A filament winding method using the filament winding apparatus includes a temporary suspending step of temporarily suspending operation of the winding device in the middle of winding the fed-out fiber portion around the workpiece. In the temporary suspending step, the length of the feeding path is increased by moving the pressing member while causing the pressing member to press against the fed-out fiber portion in a state of continuing to feed out the fed-out fiber portion from the fiber roll portion.

12 Claims, 11 Drawing Sheets

(56) References Cited

U.S. PATENT DOCUMENTS

| | | | | |
|---|---|---|---|---|
| 2002/0060265 | A1* | 5/2002 | Watson | B65H 55/04 242/470 |
| 2005/0066688 | A1* | 3/2005 | Eis | C03B 37/032 65/486 |
| 2009/0026243 | A1* | 1/2009 | Marangoni | B29D 30/1628 226/14 |
| 2009/0152388 | A1* | 6/2009 | Hinc | B29D 30/1635 242/155 R |
| 2009/0314872 | A1* | 12/2009 | Uozumi | B29C 53/8016 242/410 |
| 2013/0153704 | A1* | 6/2013 | Miura | B65H 59/36 242/562 |
| 2015/0021425 | A1* | 1/2015 | Yamaguchi | B65H 59/387 242/419 |
| 2017/0313007 | A1 | 11/2017 | Fujimoto et al. | |
| 2018/0236735 | A1* | 8/2018 | Nishibu | B29C 53/8041 |
| 2020/0224823 | A1* | 7/2020 | Hatta | B29C 63/08 |

FOREIGN PATENT DOCUMENTS

| | | | | |
|---|---|---|---|---|
| DE | 102008010365 | A1 * | 8/2009 | B65H 51/20 |
| DE | 102012218178 | A1 * | 11/2013 | B29B 11/16 |
| EP | 1604932 | A1 * | 12/2005 | B65H 51/20 |
| EP | 1975106 | A2 * | 10/2008 | B65H 59/36 |
| EP | 3363756 | A1 * | 8/2018 | B65H 54/20 |
| GB | 455938 | A | 10/1936 | |
| JP | S63-312825 | A | 12/1988 | |
| JP | 2003-221163 | A | 8/2003 | |
| JP | 2004-209923 | A | 7/2004 | |
| JP | 2005-255359 | A | 9/2005 | |
| JP | 2010126297 | A * | 6/2010 | |
| JP | 2011245780 | A * | 12/2011 | |
| JP | 2017-196809 | A | 11/2017 | |
| JP | 2018-134826 | A | 8/2018 | |
| JP | 2019072895 | A * | 5/2019 | |
| JP | 2019107772 | A * | 7/2019 | |
| JP | 2020020349 | A * | 2/2020 | |
| KR | 20070096558 | A * | 10/2007 | B65H 59/10 |
| KR | 20120122566 | A * | 11/2012 | |
| WO | WO-2009101844 | A1 * | 8/2009 | B65H 51/20 |
| WO | WO-2013053634 | A1 * | 4/2013 | B65H 51/20 |
| WO | WO-2018013033 | A1 * | 7/2018 | B65H 59/34 |
| WO | WO-2019054084 | A1 * | 3/2019 | B29C 53/602 |
| WO | WO-2020080996 | A1 * | 4/2020 | B65H 51/20 |

OTHER PUBLICATIONS

Office Action dated Nov. 29, 2024 issued in the corresponding Chinese Patent Application No. 202210656493.9 with the English machine translation thereof.

* cited by examiner

FILAMENT WINDING METHOD AND FILAMENT WINDING APPARATUS

CROSS-REFERENCE TO RELATED APPLICATIONS

This application is based upon and claims the benefit of priority from Japanese Patent Application No. 2021-097340 filed on Jun. 10, 2021, the contents of which are incorporated herein by reference.

BACKGROUND OF THE INVENTION

Field of the Invention

The present invention relates to a filament winding method and a filament winding apparatus.

Description of the Related Art

JP 2005-255359 A discloses a filament winding apparatus (hereinafter also referred to as an FW apparatus). The FW apparatus includes a bobbin motor, a winding device, and a tension applying device. The bobbin motor rotates a bobbin member. The bobbin member includes a bobbin and a fiber roll portion formed by winding a fiber bundle around the bobbin. The winding device winds a fed-out fiber portion around a workpiece with tension being applied to the fed-out fiber portion fed out from the fiber roll portion.

The tension applying device is provided in a feeding path of the fed-out fiber portion from a bobbin driving unit to the winding device. The tension applying device includes a pressing member (dancer roll) that presses the fed-out fiber portion. The pressing member of the tension applying device of the FW apparatus presses the fed-out fiber portion with a constant force. The tension applying device generally performs feedback control in which the position of the pressing member and the pressing force are made constant by detecting the position of the pressing portion and controlling the feeding speed from the fiber roll portion based on a change in the position. In addition, active control may be also performed in which the pressing member is moved in accordance with the winding speed or the winding length of the winding device in a case where feedback control cannot keep up with high-speed operation. The tension of the fed-out fiber portion is made constant by these tension applying devices.

SUMMARY OF THE INVENTION

In the filament winding method using the FW apparatus, in order to perform a predetermined intermediate process, a temporary suspending step of temporarily suspending the operation of the winding device in the middle of winding the fed-out fiber portion around the workpiece may be performed. The intermediate process includes, for example, measuring the winding accuracy of the fed-out fiber portion wound around the workpiece. The intermediate process may include, for example, changing the winding angle of the fed-out fiber portion with respect to the workpiece. The above-described related art does not describe the temporary suspending step.

When feeding of the fed-out fiber portion from the fiber roll portion is stopped (suspended) in the temporary suspending step, a relatively large tension acts on the fed-out fiber portion. In this case, the fiber roll portion may be excessively tightened by the fed-out fiber portion, resulting in deformation of the fiber roll portion. When the fiber roll portion is deformed, it is necessary to correct the fiber roll portion or replace the bobbin member. Therefore, the time required for the filament winding becomes long and the cost of the filament winding becomes high.

An object of the present invention is to solve the aforementioned problem.

According to an aspect of the present invention, there is provided a filament winding method using a filament winding apparatus, wherein the filament winding apparatus includes: a bobbin driving unit configured to rotate a bobbin member including a bobbin and a fiber roll portion formed by winding a fiber bundle around the bobbin; a winding device configured to wind a fed-out fiber portion fed out from the fiber roll portion around a workpiece in a state in which tension is applied to the fed-out fiber portion; and a tension applying device provided in a feeding path of the fed-out fiber portion from the bobbin driving unit to the winding device, the tension applying device including a pressing member configured to press against the fed-out fiber portion, the filament winding method including: a temporary suspending step of temporarily suspending operation of the winding device in a middle of winding the fed-out fiber portion around the workpiece, wherein in the temporary suspending step, a length of the feeding path is increased by moving the pressing member while causing the pressing member to press against the fed-out fiber portion in a state of continuing to feed out the fed-out fiber portion from the fiber roll portion.

According to another aspect of the present invention, there is provided a filament winding apparatus including: a bobbin driving unit configured to rotate a bobbin member including a bobbin and a fiber roll portion formed by winding a fiber bundle around the bobbin; a winding device configured to wind a fed-out fiber portion fed out from the fiber roll portion around a workpiece in a state in which tension is applied to the fed-out fiber portion; and a tension applying device provided in a feeding path of the fed-out fiber portion from the bobbin driving unit to the winding device, the tension applying device including a pressing member configured to press against the fed-out fiber portion; a bobbin control unit configured to control the bobbin driving unit; a winding control unit configured to control the winding device; and a tension control unit configured to control the tension applying device, wherein the winding control unit controls the winding device to temporarily suspend operation of the winding device in a middle of winding of the fed-out fiber portion around the workpiece, and when the winding control unit temporarily suspends the operation of the winding device in the middle of the winding, the bobbin control unit controls the bobbin driving unit to continue to feed out the fed-out fiber portion from the fiber roll portion, and the tension control unit controls the tension applying device to move the pressing member while causing the pressing member to press against the fed-out fiber portion, thereby increasing a length of the feeding path.

According to the present invention, feeding-out of the fed-out fiber portion from the fiber roll portion is continued during the temporary suspending step. Thus, since the fiber roll portion is not excessively tightened by the fed-out fiber portion during the temporary suspending step, it is possible to suppress deformation of the fiber roll portion. Therefore, it is possible to eliminate the need for correction of the fiber roll portion or replacement of the bobbin member. Therefore, it is possible to suppress an increase in the time required for the filament winding and suppress an increase in the cost of the filament winding.

Further, since the length of the feeding path is increased by moving the pressing member in the temporary suspending step, it is possible to continuously apply an appropriate tension to the fed-out fiber portion. Accordingly, it is possible to prevent the fed-out fiber portion wound around the workpiece from being loosened.

The above and other objects features and advantages of the present invention will become more apparent from the following description when taken in conjunction with the accompanying drawings in which a preferred embodiment of the present invention is shown by way of illustrative example.

DESCRIPTION OF THE INVENTION

Figure 1:
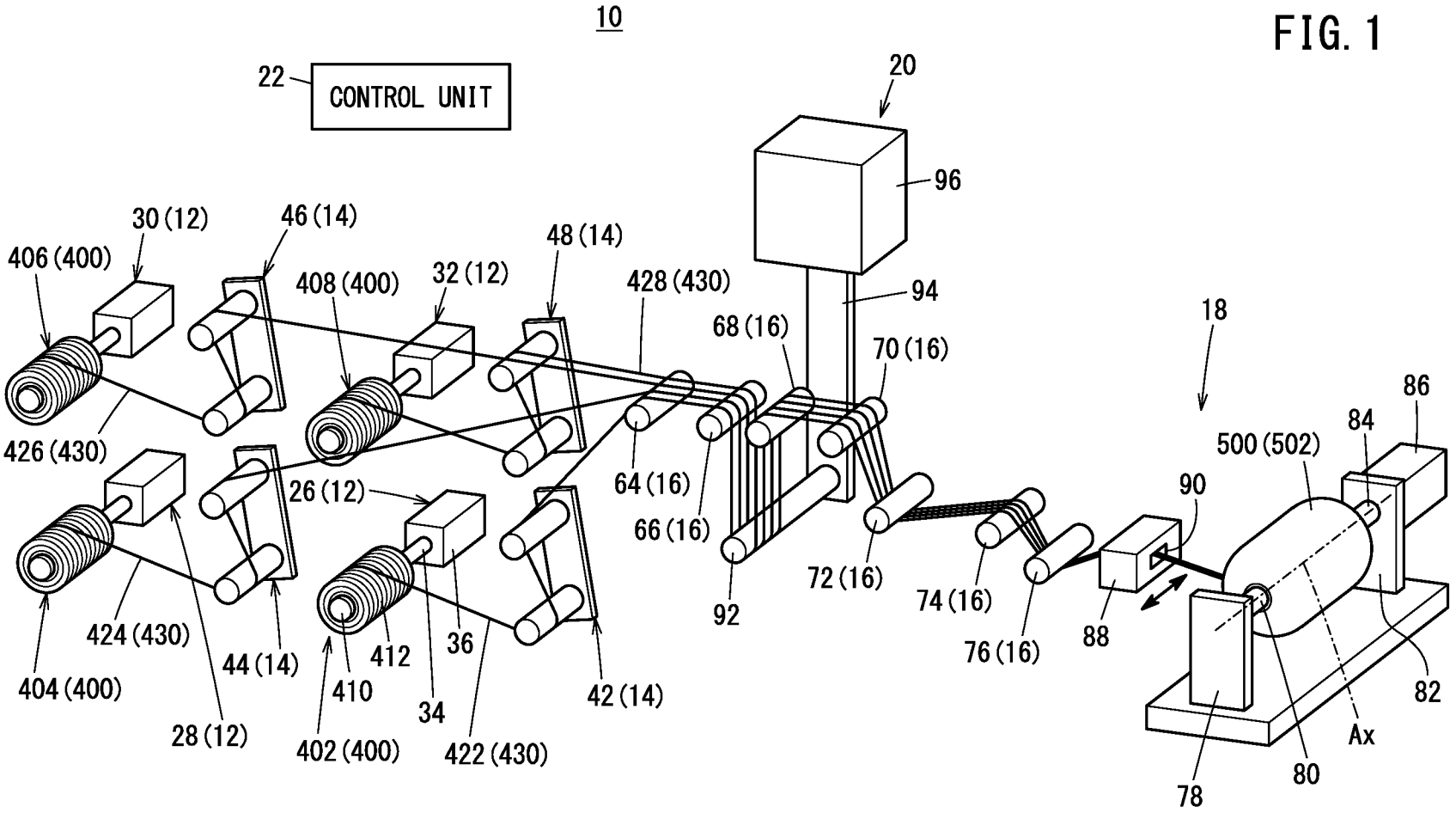
FIG. 1 is a schematic configuration diagram of a filament winding apparatus according to an embodiment of the present invention.

As shown in FIG. 1, a filament winding apparatus (hereinafter may be referred to as an "FW apparatus 10") according to an embodiment of the present invention manufactures a high-pressure gas tank 502 by winding a plurality of fed-out fiber portions 430 fed out from a plurality of bobbin members 400 around a workpiece 500. The high-pressure gas tank 502 manufactured using the FW apparatus 10 is mounted on, for example, a fuel cell vehicle. In this case, the high-pressure gas tank 502 is filled with hydrogen gas at a high pressure. Note that the high-pressure gas tank 502 may be filled with fuel gas other than hydrogen gas.

Figure 2:
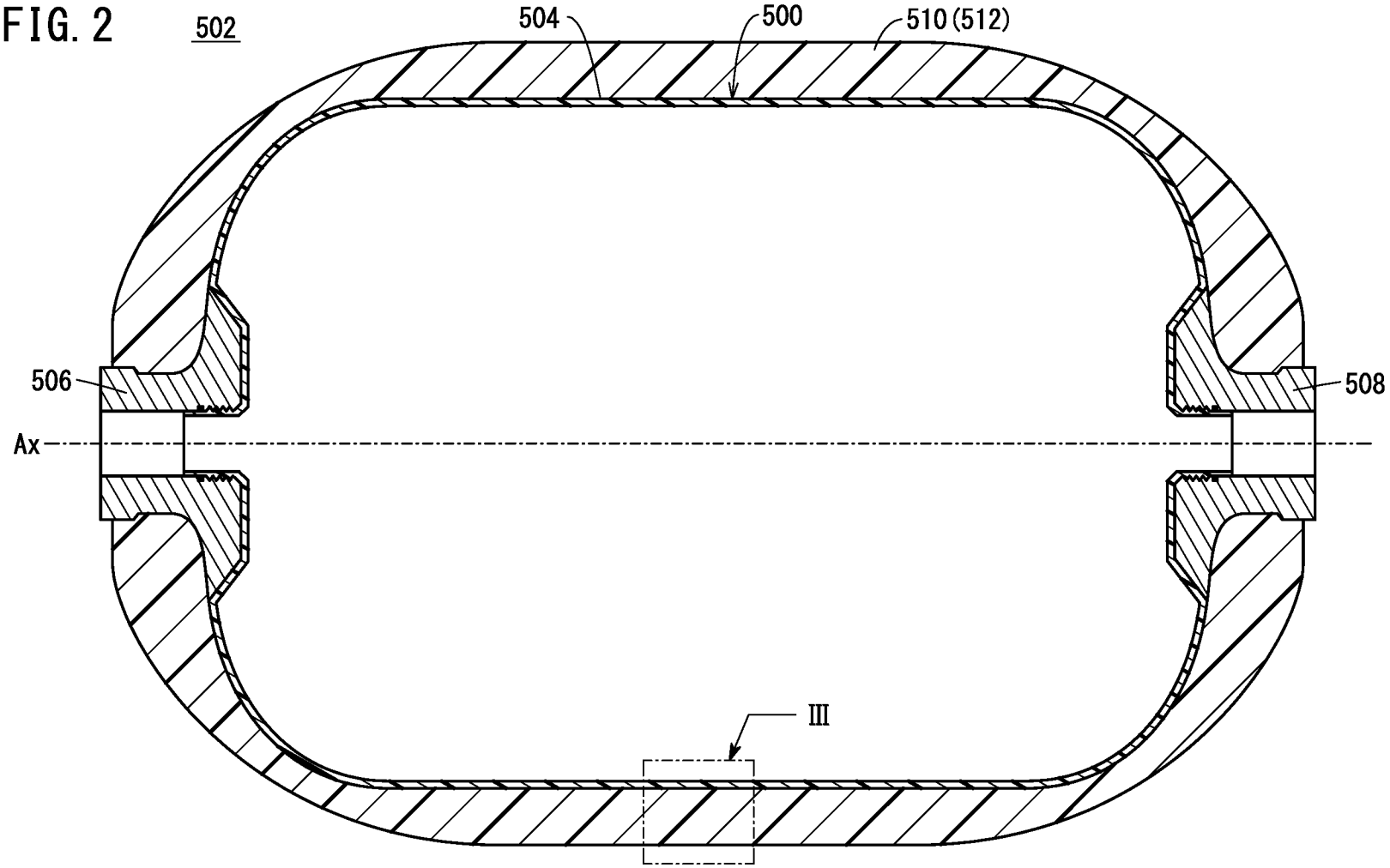
FIG. 2 is a schematic longitudinal sectional view of the high-pressure gas tank.
Figure 3:
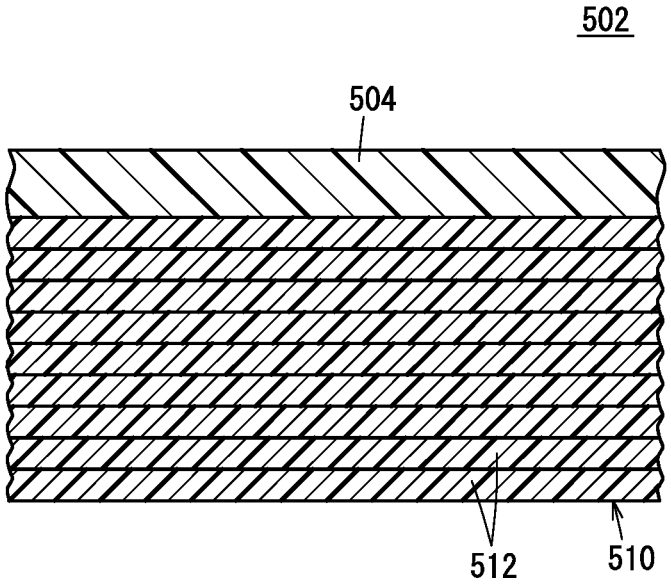
FIG. 3 is a detailed cross-sectional view of a portion indicated by arrow III in FIG. 2.

In FIG. 2, the high-pressure gas tank 502 includes a liner 504, a first cap 506, a second cap 508, and a reinforcing portion 510. The liner 504, the first cap 506, and the second cap 508 form a workpiece 500. The liner 504 is made of, for example, high-density polyethylene (HDPE) resin or nylon resin (PA6) having hydrogen-barrier properties. The first cap 506 is attached to one end portion of the liner 504 in the axial direction. A second cap 508 is attached to the other end portion of the liner 504 in the axial direction. The reinforcing portion 510 includes a plurality of reinforcing layers 512 laminated in the thickness direction of the liner 504 (see FIG. 3).

A product manufactured using the FW apparatus 10 is not limited to the high-pressure gas tank 502. That is, a product manufactured by using the FW apparatus 10 may be, for example, a solid member.

As illustrated in FIG. 1, the FW apparatus 10 includes a plurality of bobbin driving units 12, a plurality of tension holding units 14, a plurality of feed rollers 16, a winding device 18, a tension applying device 20, and a control unit 22.

In the present embodiment, the number of the bobbin driving units 12 is four. The number of the bobbin driving units 12 can be set as appropriate. The plurality of bobbin driving units 12 include a first bobbin driving unit 26, a second bobbin driving unit 28, a third bobbin driving unit 30, and a fourth bobbin driving unit 32. The first bobbin driving unit 26 includes a bobbin support shaft 34 and a bobbin motor 36. The bobbin motor 36 rotates a bobbin support portion. The configuration of each of the second bobbin driving unit 28, the third bobbin driving unit 30, and the fourth bobbin driving unit 32 is the same as that of the first bobbin driving unit 26.

A plurality of bobbin members 400 are attachable to and detachable from the FW apparatus 10. In the present embodiment, the number of the plurality of bobbin members 400 is four. The plurality of bobbin members 400 include a first bobbin member 402, a second bobbin member 404, a third bobbin member 406, and a fourth bobbin member 408.

The first bobbin member 402 includes a bobbin 410 and a fiber roll portion 412. The bobbin 410 is attached to the bobbin support shaft 34. A fiber bundle is traverse-wound around the bobbin 410. In other words, the fiber bundle is wound around the bobbin 410 while moving the fiber bundle in the width direction of the bobbin 410 (i.e., in the axial direction of the bobbin 410).

The fiber bundle is formed by bundling a large number of fibers. As the fibers forming the fiber bundle, for example, carbon fibers or glass fibers are used. The fiber bundle is impregnated with resin in advance. As the resin with which the fiber bundle is impregnated, for example, an epoxy resin, which is a thermosetting resin, is used. That is, the fiber bundle is a so-called tow prepreg. The fiber roll portion 412 is formed by winding a fiber bundle around the bobbin 410. The fiber bundle is fed out (reeled out) from the fiber roll portion 412 by rotation of the bobbin 410.

Each of the second bobbin member 404, the third bobbin member 406, and the fourth bobbin member 408 has the same configuration as the first bobbin member 402. Therefore, description of the configuration of each of the second bobbin member 404, the third bobbin member 406, and the fourth bobbin member 408 will be omitted.

Hereinafter, a portion of the fiber bundle of the first bobbin member 402 that is fed out from the fiber roll portion 412 is referred to as a "first fed-out fiber portion 422". A portion of the fiber bundle of the second bobbin member 404 fed out from the fiber roll portion 412 is referred to as a "second fed-out fiber portion 424". A portion of the third bobbin member 406 that is fed out from the fiber roll portion 412 is referred to as a "third fed-out fiber portion 426". A portion of the fourth bobbin member 408 that is fed out from the fiber roll portion 412 is referred to as a "fourth fed-out fiber portion 428". Further, each of the first fed-out fiber portion 422, the second fed-out fiber portion 424, the third fed-out fiber portion 426, and the fourth fed-out fiber portion 428 may be referred to as a "fed-out fiber portion 430".

In the present embodiment, the number of the plurality of tension holding units 14 is four. The number of the plurality of tension holding units 14 is the same as the number of the plurality of bobbin driving units 12. The number of the plurality of tension holding units 14 can be appropriately set similarly to the plurality of bobbin driving units 12. The plurality of tension holding units 14 include a first tension holding unit 42, a second tension holding unit 44, a third tension holding unit 46, and a fourth tension holding unit 48. The first tension holding unit 42 absorbs fluctuation in tension acting on the first fed-out fiber portion 422. In other words, the first tension holding unit 42 holds the tension acting on the first fed-out fiber portion 422 within a reference tension range.

Figure 4A:
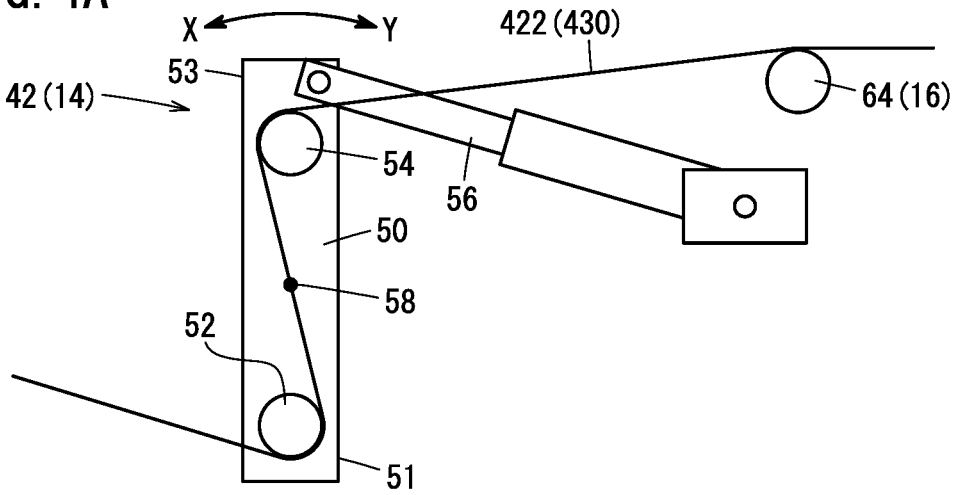
FIG. 4A is an explanatory plan view of a first tension holding unit shown in FIG. 1.

As shown in FIG. 4A, the first tension holding unit 42 includes a base portion 50, a first holding roller 52, a second holding roller 54, and an air cylinder 56. The base portion 50 has a rectangular shape. The base portion 50 includes a first end portion 51 and a second end portion 53. The first end portion 51 is one end portion of the base portion 50 in the longitudinal direction. The second end portion 53 is the other end portion of the base portion 50 in the longitudinal direction. The first holding roller 52 is rotatably attached to the first end portion 51. The second holding roller 54 is rotatably attached to the second end portion 53. The first fed-out fiber portion 422 is wound around the first holding roller 52 and the second holding roller 54.

The base portion 50 is tiltable (swingable) about an axis for tilting (which will thereinafter be simply referred to as a tilting axis) 58. The tilting axis 58 is located between the first holding roller 52 and the second holding roller 54. The base portion 50 tilts (swings) in a first rotation direction (a direction indicated by arrow X) and a second rotation direction (a direction indicated by arrow Y) about the tilting axis 58. The air cylinder 56 biases (pushes) the second end portion 53 in the first rotation direction. The second holding roller 54 is at a reference position shown in FIG. 4A in a state in which a reference tension acts on the first fed-out fiber portion 422. At this time, the reference tension acting on the first fed-out fiber portion 422 and the biasing force of the air cylinder 56 are balanced with each other.

Figure 4B:
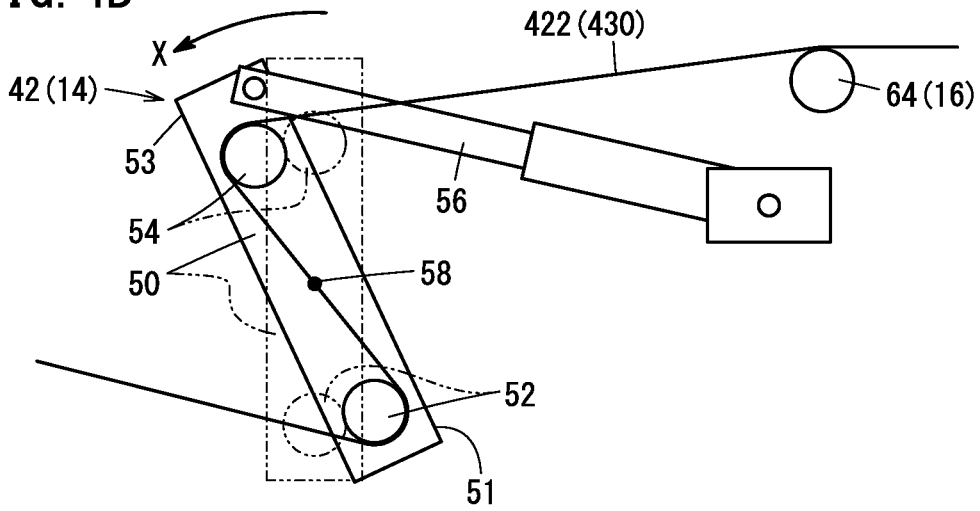
FIG. 4B is a first operation explanatory diagram of the first tension holding unit shown in FIG. 4A.

When the tension acting on the first fed-out fiber portion 422 becomes smaller than the reference tension, the base portion 50 is pushed by the biasing force of the air cylinder 56 and tilts in the first rotation direction about the tilting axis 58, as shown in FIG. 4B. Then, the second holding roller 54 is displaced from the reference position to a first position. As a result, since the path length of the first fed-out fiber portion 422 becomes long, the tension acting on the first fed-out fiber portion 422 becomes large. That is, the tension acting on the first fed-out fiber portion 422 is maintained at or above the lower limit value of the reference tension range.

Figure 4C:
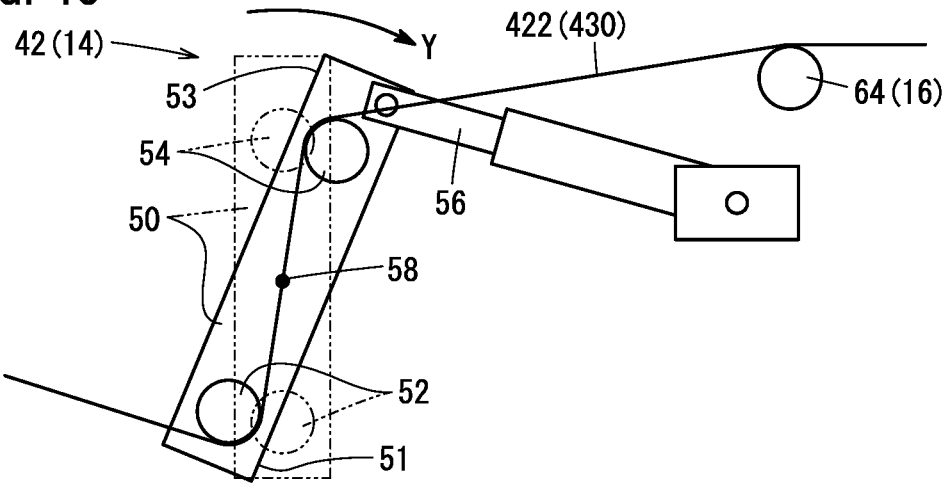
FIG. 4C is a second operation explanatory diagram of the first tension holding unit shown in FIG. 4A.

When the tension acting on the first fed-out fiber portion 422 becomes larger than the reference tension, the base portion 50 tilts in the second rotation direction about the tilting axis 58 while pushing the air cylinder 56 by the tension of the first fed-out fiber portion 422, as shown in FIG. 4C. Then, the second holding roller 54 is displaced from the reference position to a second position. Accordingly, the path length of the first fed-out fiber portion 422 is shortened, and thus the tension acting on the first fed-out fiber portion 422 is reduced. That is, the tension acting on the first fed-out fiber portion 422 is maintained at or below the upper limit value of the reference tension range. The first tension holding unit 42 may include a hydraulic cylinder, a spring member, or the like, instead of the air cylinder 56.

The second tension holding unit 44 holds the tension acting on a second extended fiber bundle within a reference tension range. The third tension holding unit 46 holds the tension acting on a third extended fiber bundle within a reference tension range. The fourth tension holding unit 48 holds the tension acting on a fourth extended fiber bundle within a reference tension range. Each of the second tension holding unit 44, the third tension holding unit 46, and the fourth tension holding unit 48 is configured in the same manner as the first tension holding unit 42. Therefore, description of the configuration of each of the second tension holding unit 44, the third tension holding unit 46, and the fourth tension holding unit 48 will be omitted.

Each tension holding unit 14 is not limited to the configuration described above, and an appropriate configuration may be adopted.

As shown in FIG. 1, the plurality of feed rollers 16 feed the plurality of fed-out fiber portions 430 having passed through the plurality of tension holding units 14, to the winding device 18. Each feed roller 16 is rotatably attached to a roller support member (not shown). The first fed-out fiber portion 422, the second fed-out fiber portion 424, the third fed-out fiber portion 426, and the fourth fed-out fiber portion 428 are wound around each feed roller 16.

The plurality of feed rollers 16 include a first feed roller 64, a second feed roller 66, a third feed roller 68, a fourth feed roller 70, a fifth feed roller 72, a sixth feed roller 74, and a seventh feed roller 76. The first feed roller 64, the second feed roller 66, the third feed roller 68, the fourth feed roller 70, the fifth feed roller 72, the sixth feed roller 74, and the seventh feed roller 76 are arranged in this order in the feeding direction of the plurality of fed-out fiber portions 430. The number of feed rollers 16 can be changed as appropriate.

The winding device 18 winds the plurality of fed-out fiber portions 430 around the outer surface of the workpiece 500 while rotating the workpiece 500 about the axis Ax of the workpiece 500. The winding device 18 includes a first support stand 78, a first support shaft 80, a second support stand 82, a second support shaft 84, a rotary motor 86, and a fiber supply head 88.

The first support stand 78 rotatably supports the first support shaft 80. The first support shaft 80 is attachable to and detachable from the first cap 506 of the workpiece 500. The second support stand 82 rotatably supports the second support shaft 84. The second support shaft 84 is attachable to and detachable from the second cap 508 of the workpiece 500. The rotary motor 86 rotates the second support shaft 84. The rotary motor 86 is fixed to the second support stand 82. The rotary motor 86 integrally rotates the first support shaft 80, the workpiece 500, and the second support shaft 84 about the axis Ax of the workpiece 500.

Hereinafter, a direction along the axis Ax of the workpiece 500 is referred to as an "axial direction of the workpiece 500". The fiber supply head 88 supplies the plurality of fed-out fiber portions 430 to the workpiece 500 in a bundled state. The fiber supply head 88 is movable along the axial direction of the workpiece 500. The fiber supply head 88 has an insertion hole 90 through which the plurality of fed-out fiber portions 430 are inserted. The winding device 18 winds the plurality of fed-out fiber portions 430 around the workpiece 500 in a plurality of layers by helical winding, hoop winding, or the like.

The tension applying device 20 is provided in a feeding path of the plurality of fed-out fiber portions 430 from the plurality of bobbin driving units 12 to the winding device 18. The tension applying device 20 applies tension to the plurality of fed-out fiber portions 430. The tension applying device 20 includes a pressing member 92, a pressing support member 94, and an actuator 96.

The pressing member 92 is a roller extending in the horizontal direction. The pressing member 92 presses each fed-out fiber portion 430 downward (in the direction of gravity). Specifically, the pressing member 92 presses a portion of each of the fed-out fiber portions 430 that lies between the second feed roller 66 and the third feed roller 68. The portion of each fed-out fiber portion 430 pressed by the pressing member 92 can be changed as appropriate. That is, the pressing member 92 may press, for example, a portion between the first feed roller 64 and the second feed roller 66 in each of the fed-out fiber portions 430.

The pressing support member 94 rotatably supports the pressing member 92. The pressing support member 94 extends in the up-down direction. The actuator 96 moves the pressing support member 94 in the up-down direction. Although detailed illustration is omitted, the actuator 96 includes, for example, a motor and a ball screw. However, the actuator 96 may be an air cylinder or the like.

Figure 5:
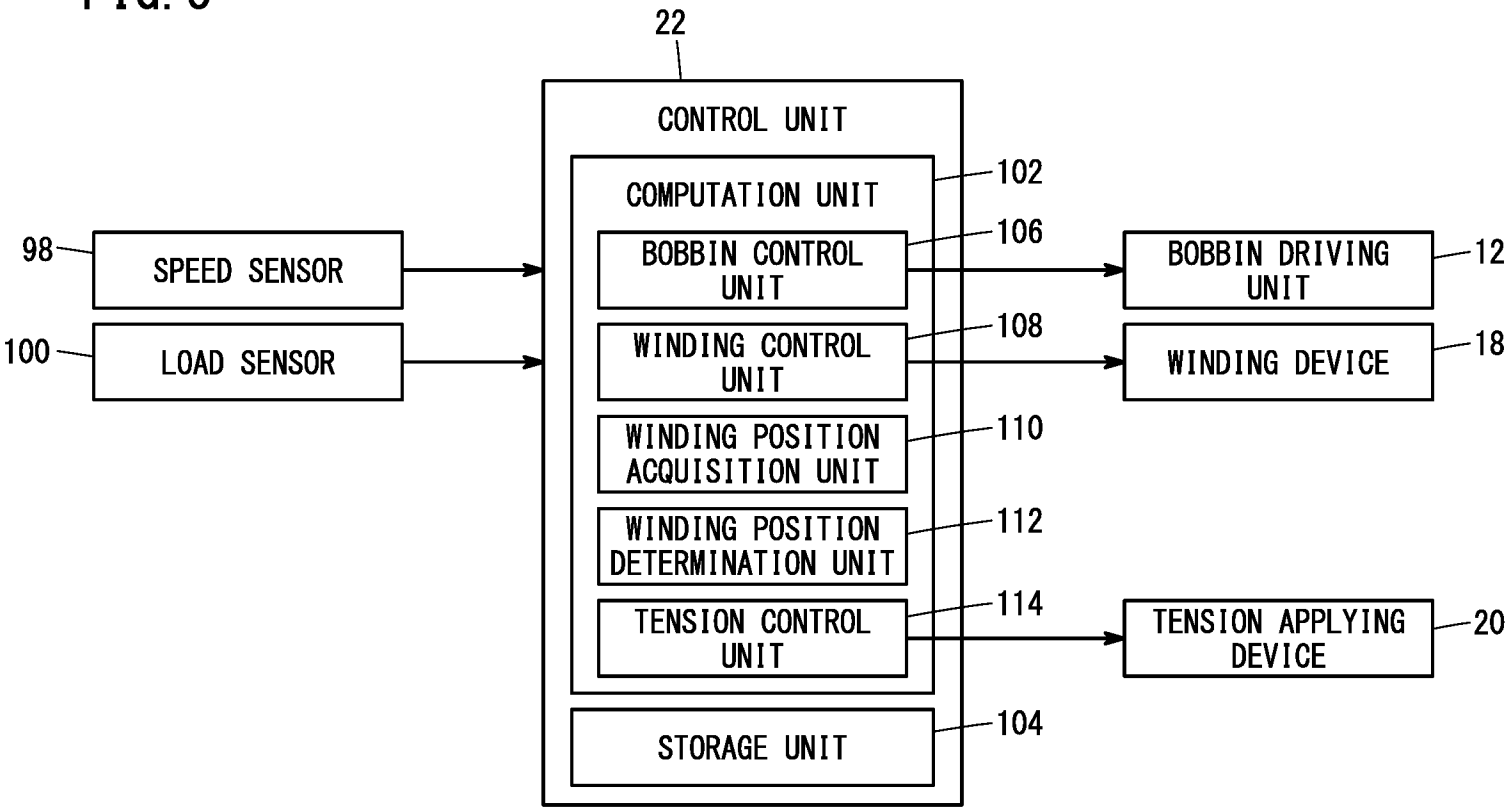
FIG. 5 is a control block diagram of FIG. 1.

As shown in FIG. 5, the FW apparatus 10 includes a speed sensor 98 and a load sensor 100. The speed sensor 98 detects the feed speed of each of the fed-out fiber portions 430. The speed sensor 98 transmits the detected feed speed to the control unit 22. The load sensor 100 detects the total sum of loads received by the pressing member 92 from the fed-out fiber portions 430. The load sensor 100 transmits the detected load to the control unit 22.

The control unit 22 includes a computation unit 102 (processing unit) and a storage unit 104. The computation unit 102 is configured by, for example, a processor (processing circuitry) such as a CPU (Central Processing Unit) or a GPU (Graphics Processing Unit).

The computation unit 102 includes a bobbin control unit 106, a winding control unit 108, a winding position acquisition unit 110, a winding position determination unit 112, and a tension control unit 114. The computation unit 102 implements the bobbin control unit 106, the winding control unit 108, the winding position acquisition unit 110, the winding position determination unit 112, and the tension control unit 114 by executing programs stored in the storage unit 104.

The computation unit 102 may realize at least part of the bobbin control unit 106, the winding control unit 108, the winding position acquisition unit 110, the winding position determination unit 112, and the tension control unit 114 by an integrated circuit. Examples of the integrated circuit include an application specific integrated circuit (ASIC), a field-programmable gate array (FPGA), and the like.

The storage unit 104 includes a volatile memory and a nonvolatile memory. Examples of the volatile memory include, for example, a RAM (Random Access Memory) or the like. As an example of the nonvolatile memory, there may be cited a ROM (Read Only Memory), a flash memory, or the like. Data and the like are stored in, for example, the volatile memory. Programs, tables, maps, and the like are stored, for example, in the nonvolatile memory. At least a portion of the storage unit 104 may be incorporated into a processor or integrated circuit as described above.

The bobbin control unit 106 controls the bobbin driving unit 12. The winding control unit 108 controls the winding device 18. Specifically, the winding control unit 108 controls the rotary motor 86 to rotate the workpiece 500. The winding control unit 108 controls the fiber supply head 88 to move the fiber supply head 88 along the axial direction of the workpiece 500. The winding control unit 108 synchronously controls the rotary motor 86 and the fiber supply head 88.

The winding position acquisition unit 110 acquires a winding position at which each fed-out fiber portion 430 is wound on the workpiece 500. The winding position acquisition unit 110 calculates the winding position of each of the fed-out fiber portions 430 on the workpiece 500 based on, for example, information of the workpiece 500 and operation information of the winding device 18. The information of the workpiece 500 includes the shape of the workpiece 500 and the size of the workpiece 500. The operation information of the winding device 18 includes a rotation amount of the rotary motor 86 and position information of the fiber supply head 88. Note that the winding position acquisition unit 110 may acquire the winding position of each fed-out fiber portion 430 on the workpiece 500, using a camera or the like.

The winding position determination unit 112 determines whether or not the winding position of each of the fed-out fiber portions 430 on the workpiece 500 is located in a tension reduction region. The tension reduction region is a region of the winding position where the tension acting on each of the fed-out fiber portions 430 may be lower than the lower limit value of the reference tension range.

In addition, the winding position determination unit 112 determines whether or not the winding position of each of the fed-out fiber portions 430 on the workpiece 500 is located in a tension increase region. The tension increase region is a region of the winding position where the tension acting on each of the fed-out fiber portions 430 may be higher than the upper limit value of the predetermined tension range.

Further, the winding position determination unit 112 determines whether or not the winding position of each of the fed-out fiber portions 430 on the workpiece 500 is at a temporary suspending position. The temporary suspending position is appropriately set according to the shape, size, and the like of the workpiece 500. In the present embodiment, the temporary suspending position is set to a winding position of each of the fed-out fiber portions 430 on the workpiece 500 at the time when one reinforcing layer 512 has been formed. That is, the winding position of each fed-out fiber portion 430 on the workpiece 500 is located at the temporary suspending position every time one reinforcing layer 512 is formed.

Information on the tension reduction region, the tension increase region, and the temporary suspending position is stored in the storage unit 104 in advance. The tension reduction region and the tension increase region are obtained, for example, by performing a test or the like in advance. However, the tension reduction region and the tension increase region may be calculated by simulation.

The tension control unit 114 controls the tension applying device 20. Specifically, the tension control unit 114 controls the actuator 96 to move the pressing member 92 in the up-down direction.

Next, a filament winding method (hereinafter referred to as "FW method") using the FW apparatus 10 will be described.

Figure 6:
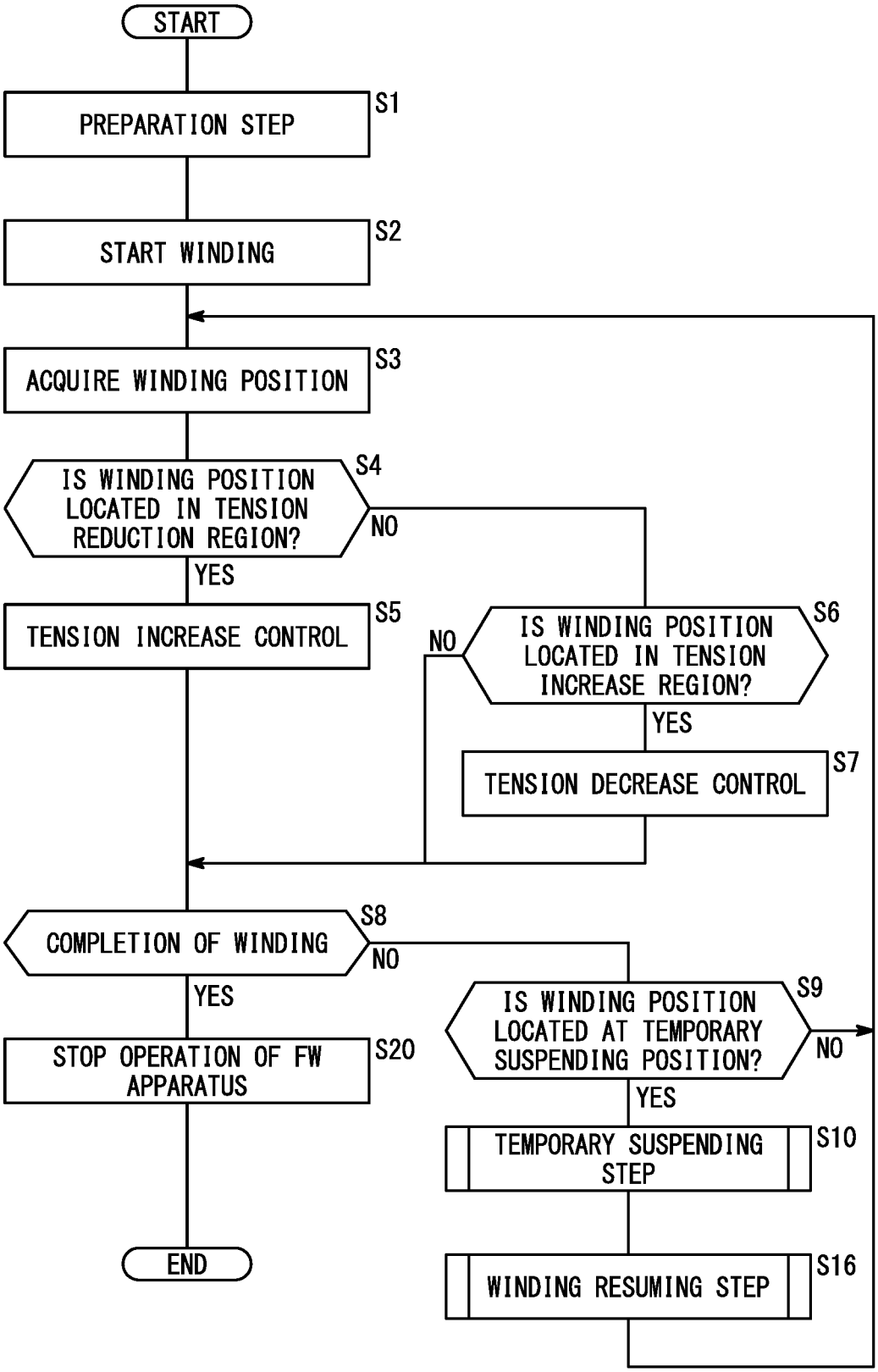
FIG. 6 is a flowchart for explaining a filament winding method.
Figure 7A:
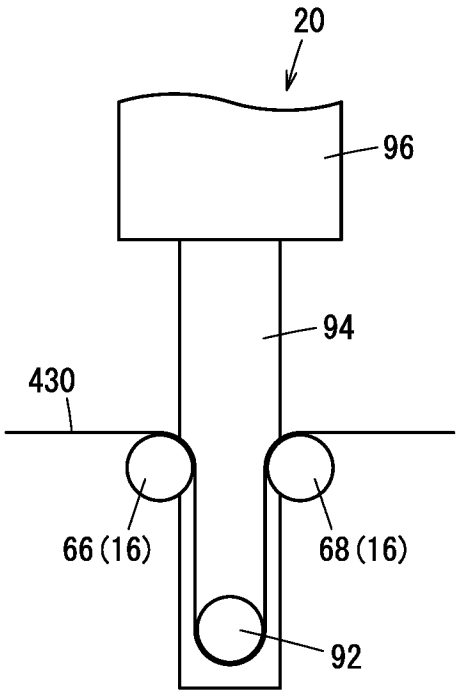
FIG. 7A is an explanatory plan view of a tension applying device.

As shown in FIG. 6, the FW method includes a preparation step (step S1). In the preparation step, the plurality of bobbin members 400 are attached to the plurality of bobbin driving units 12, respectively. In addition, each of the fed-out fiber portions 430 is wound around each of the feed rollers 16. Further, each of the fed-out fiber portions 430 is passed through the insertion hole 90 of the fiber supply head 88. Further, a winding end (starting end) of each fed-out fiber portion 430 onto the workpiece 500 is fixed to the outer surface of the workpiece 500. Note that, as shown in FIG. 7A, in an initial state before the winding of each of the fed-out fiber portions 430 around the workpiece 500 is started, each of the fed-out fiber portions 430 is wound around the pressing member 92. In other words, in the initial state, the pressing member 92 presses each of the fed-out fiber portions 430. As a result, the reference tension acts on each fed-out fiber portion 430.

Subsequently, winding of the plurality of fed-out fiber portions 430 around the workpiece 500 is started (step S2). Specifically, the bobbin control unit 106 controls each bobbin driving unit 12 to rotate each bobbin motor 36. The winding control unit 108 controls the rotary motor 86 to rotate the workpiece 500. Furthermore, the winding control unit 108 controls the fiber supply head 88 to move the fiber supply head 88 in the axial direction of the workpiece 500.

Accordingly, each of the fed-out fiber portions 430 is fed out from each of the plurality of fiber roll portions 412. Each fed-out fiber portion 430 is fed to the fiber supply head 88 via each tension holding unit 14 and a plurality of feed rollers 16. The plurality of fed-out fiber portions 430 fed to the fiber supply head 88 are wound around the outer surface of the workpiece 500 with the fed-out fiber portions being bundled into one. At this time, fluctuation in the tension of each fed-out fiber portion 430 is basically absorbed by each tension holding unit 14. Therefore, tension within the reference tension range continues to act on each of the fed-out fiber portions 430.

When winding of the plurality of fed-out fiber portions 430 around the workpiece 500 is started, the winding position acquisition unit 110 acquires the winding position of each of the fed-out fiber portions 430 on the workpiece 500 (step S3). Subsequently, the winding position determination unit 112 determines whether or not the acquired winding position is located in the tension reduction region (step S4). When the winding position is located in the tension reduction region, a decrease in tension acting on each fed-out fiber portion 430 can no longer be absorbed only by each tension holding unit 14. That is, in this case, there is a possibility that the tension acting on each of the fed-out fiber portions 430 becomes lower than the lower limit value of the reference tension range. Therefore, when the winding position is located in the tension reduction region (step S4: YES), the tension control unit 114 performs tension increase control (step S5).

Figure 7B:
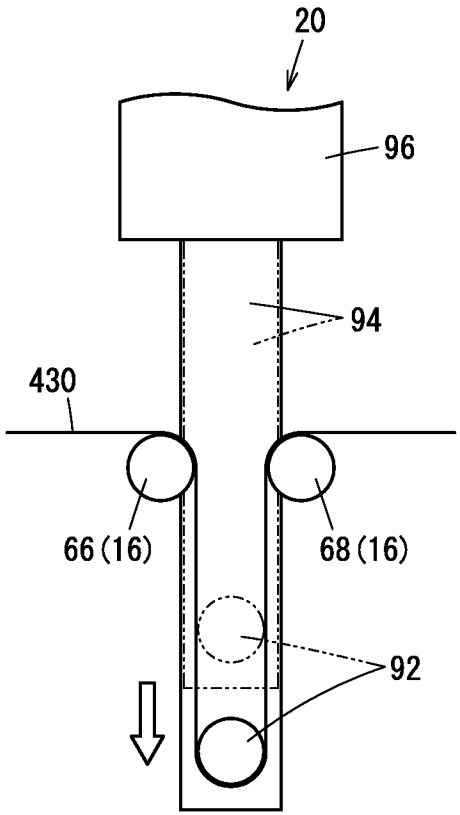
FIG. 7B is a first operation explanatory view of the tension applying device shown in FIG. 7A.

As shown in FIG. 7B, in the tension increase control, the tension control unit 114 controls the actuator 96 to move the pressing member 92 downward (in the direction of gravity). Accordingly, since each of the fed-out fiber portions 430 pressed by the pressing member 92 is stretched, the tension acting on each of the fed-out fiber portions 430 increases. Accordingly, the tension acting on each of the fed-out fiber portions 430 is maintained within the reference tension range. After the tension increase control, the operation flow proceeds to step S8 (see FIG. 6) described later.

In FIG. 6, when the winding position is not located in the tension reduction region (step S4: NO), the winding position determination unit 112 determines whether the acquired winding position is located in the tension increase region (step S6). When the winding position is located in the tension increase region, an increase in tension acting on each fed-out fiber portion 430 can no longer be absorbed only by each tension holding unit 14. That is, in this case, there is a possibility that the tension acting on each of the fed-out fiber portions 430 becomes higher than the upper limit value of the reference tension range. Therefore, when the winding position is located in the tension increase region (step S6: YES), the tension control unit 114 performs tension decrease control (step S7).

Figure 7C:
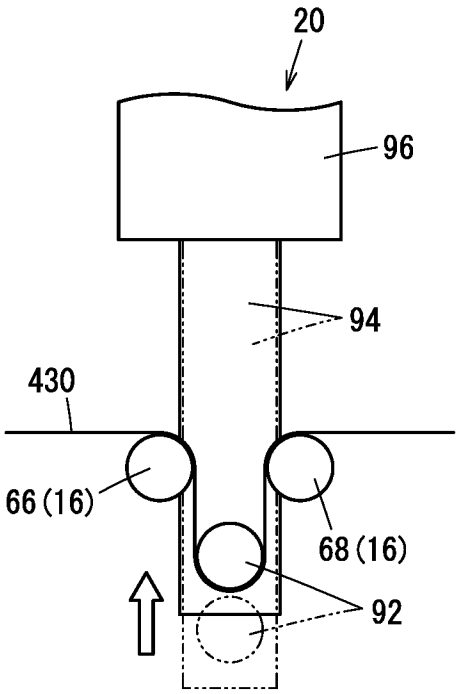
FIG. 7C is a second operation explanatory view of the tension applying device shown in FIG. 7A.

As shown in FIG. 7C, in the tension decrease control, the tension control unit 114 controls the actuator 96 to move the pressing member 92 upward (in a direction opposite to the direction of gravity). As a result, the pressing force acting on each of the fed-out fiber portions 430 from the pressing member 92 decreases, and thus the tension acting on each of the fed-out fiber portions 430 decreases. Accordingly, the tension acting on each of the fed-out fiber portions 430 is maintained within the reference tension range. After the tension decrease control, the operation flow proceeds to step S8 (see FIG. 6) described later.

In FIG. 6, when the winding position is not located in the tension increase region (step S6: NO), the control unit 22 determines whether or not winding of each of the fed-out fiber portions 430 around the workpiece 500 is completed (step S8). When the winding of each of the fed-out fiber portions 430 around the workpiece 500 is not completed (step S8: NO), the winding position determination unit 112 determines whether or not the winding position of each of the fed-out fiber portions 430 on the workpiece 500 is at the temporary suspending position (step S9).

In the present embodiment, when one reinforcing layer 512 has been formed by the plurality of fed-out fiber portions 430, the winding position of each fed-out fiber portion 430 on the workpiece 500 is located at the temporary suspending position. That is, the winding position of each of the fed-out fiber portions 430 on the workpiece 500 is located at the temporary suspending position every time each of the reinforcing layers 512 is formed. When the winding position of each of the fed-out fiber portions 430 on the workpiece 500 is at the temporary suspending position (step S9: YES), the temporary suspending step is performed (step S10).

Figure 8:
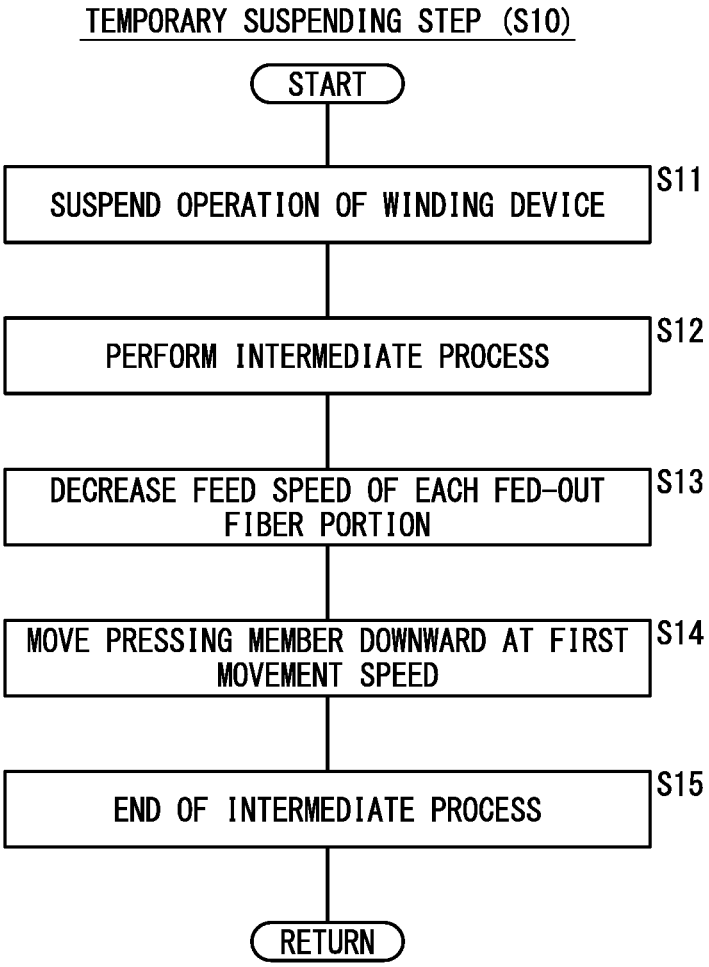
FIG. 8 is a flowchart for explaining details of the temporary suspending step in FIG. 6.

As shown in FIG. 8, in the temporary suspending step, the winding control unit 108 controls the winding device 18 to temporarily suspend (stop) the operation of the winding device 18 (step S11). Specifically, the winding control unit 108 controls the rotary motor 86 to stop the rotation of the workpiece 500. In addition, the winding control unit 108 controls the fiber supply head 88 to stop the movement of the fiber supply head 88.

At this time, an intermediate process is performed (step S12). In the intermediate process, the winding accuracy of each fed-out fiber portion 430 on the workpiece 500 is measured. In other words, in the intermediate process, the lamination accuracy of each reinforcing layer 512 is measured. In the intermediate process, the winding angle of each of the fed-out fiber portions 430 to the workpiece 500 may be set.

Further, the bobbin control unit 106 controls each bobbin motor 36 to reduce the feed speed of each fed-out fiber portion 430 (step S13). In other words, the bobbin control unit 106 controls each bobbin motor 36 to cause the feed speed of each fed-out fiber portion 430 to be slower than the feed speed of each fed-out fiber portion 430 that occurred immediately before the temporary suspending step. Further, the tension control unit 114 controls the actuator 96 to move the pressing member 92 in the downward direction (gravity direction) at a first movement speed (step S14).

Specifically, the tension control unit 114 controls the first movement speed based on the feed speed of each of the fed-out fiber portions 430 detected by the speed sensor 98 and maintains the tension of each of the fed-out fiber portions 430 within the reference tension range. In other words, the tension control unit 114 increases the first movement speed as the feed speed of each of the fed-out fiber portions 430 detected by the speed sensor 98 increases, and maintains the tension of each of the fed-out fiber portions 430 within the reference tension range. When such control is performed, the load sensor 100 may be omitted.

The tension control unit 114 may control the first movement speed based on the load detected by the load sensor 100 to thereby maintain the tension of each of the fed-out fiber portions 430 within the reference tension range. In other words, the tension control unit 114 may decrease the first movement speed as the load detected by the load sensor 100 is larger, and may maintain the tension of each of the fed-out fiber portions 430 within the reference tension range. When such control is performed, the speed sensor 98 may be omitted.

When the pressing member 92 is moved downward at the first movement speed, as shown in FIG. 7B, the length of the feeding path of each of the fed-out fiber portions 430 becomes longer while appropriate tension acts on each fed-out fiber portion 430.

In such a temporary suspending step, the feeding of each of the fed-out fiber portions 430 from each of the fiber roll portions 412 is continued. In other words, the feeding of the fed-out fiber portions 430 from the respective fiber roll portions 412 is not stopped. Therefore, each fiber roll portion 412 is not excessively tightened by each fed-out fiber portion 430.

In addition, since each of the fiber roll portions 412 rotates, the resin impregnated in the fiber bundle forming each of the fiber roll portions 412 is prevented from dropping (unevenly distributed) in the gravity direction. Therefore, it is possible to suppress non-uniform distribution of the resin impregnated in the fiber bundle. Therefore, it is possible to suppress the occurrence of a portion having insufficient strength in each of the fed-out fiber portions 430 wound around the workpiece 500.

Further, in the temporary suspending step, an appropriate tension is continuously applied to each of the fed-out fiber portions 430. In other words, in the temporary suspending step, the tension of each of the fed-out fiber portions 430 is maintained within the reference tension range. Therefore, the fed-out fiber portions 430 wound around the workpiece 500 are prevented from loosening (sagging).

Thereafter, in FIG. 8, when the intermediate process ends (step S15), the temporary suspending step ends. After the temporary suspending step, as shown in FIG. 6, the winding resuming step is performed (step S16).

Figure 9:
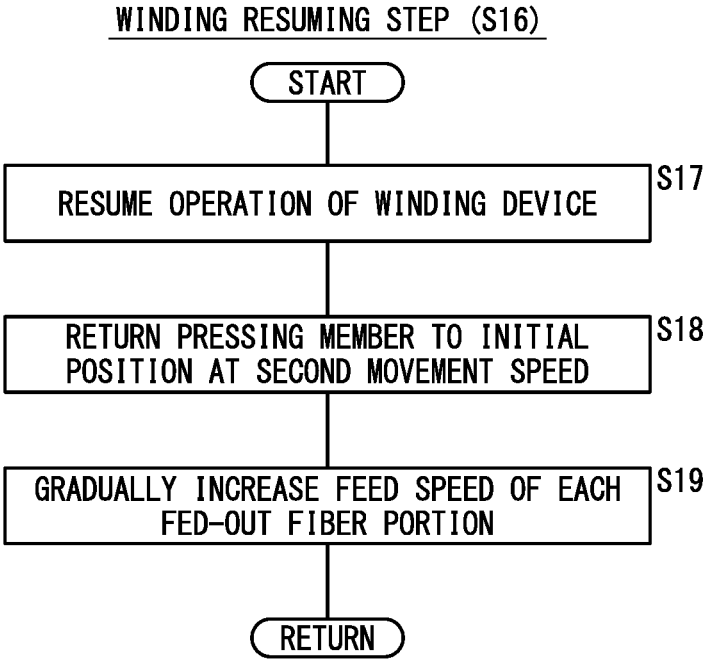
FIG. 9 is a flowchart illustrating the details of the winding resuming step of FIG. 6.

As shown in FIG. 9, in the winding resuming step, the winding control unit 108 controls the winding device 18 to resume the operation of the winding device 18 (step S17). That is, the winding control unit 108 controls the rotary motor 86 to rotate the workpiece 500. The winding control unit 108 also controls the fiber supply head 88 to move the fiber supply head 88 in the axial direction of the workpiece 500. The acceleration at which each of the fed-out fiber portions 430 is wound around the workpiece 500 in the winding resuming step is higher than the acceleration at which each of the fed-out fiber portions 430 is wound around the workpiece 500 at the time when winding starts from the initial state.

Further, the tension control unit 114 controls the actuator 96 to return the pressing member 92 to the initial position at a second movement speed (step S18). At this time, the tension control unit 114 controls the second movement speed based on the winding speed of each of the fed-out fiber portions 430 around the workpiece 500 during the winding resuming step. The second movement speed is faster than the first movement speed.

Further, the bobbin control unit 106 controls each bobbin motor 36 to gradually increase the feed speed of each fed-out fiber portion 430 (step S19). At this time, the bobbin control unit 106 controls the feed speed of each of the fed-out fiber portions 430 based on the second movement speed, and maintains the tension of each of the fed-out fiber portions 430 within the reference tension range. As a result, as shown in FIG. 7C, the length of the feeding path of each of the fed-out fiber portions 430 becomes shorter while appropriate tension acts on each of the fed-out fiber portions 430. When the pressing member 92 returns to the initial position, the winding resuming step ends. After the winding resuming step, step S3 and subsequent steps in FIG. 6 are performed.

In FIG. 6, when the winding of each of the fed-out fiber portions 430 around the workpiece 500 is completed (step S8: YES), the control unit 22 stops the operation of the FW apparatus 10 (step S20). Specifically, the winding control unit 108 controls the rotary motor 86 to stop the rotation of the workpiece 500. In addition, the winding control unit 108 controls the fiber supply head 88 to stop the operation of the fiber supply head 88. Further, the bobbin control unit 106 controls each bobbin motor 36 to stop the feeding of each fed-out fiber portion 430. Thus, the operation flow of the FW method ends.

The workpiece 500 (semi-finished product) around which the fiber bundle is wound by the FW method described above is removed from the winding device 18 and heated. As a result, the resin impregnated in the fiber bundle is cured (hardened) to form the reinforcing layers 512. That is, the high-pressure gas tank 502 including the reinforcing portion 510 is manufactured.

The present embodiment has the following advantageous effects.

The FW method includes the temporary suspending step of temporarily suspending the operation of the winding device 18 in the middle of the winding of each of the fed-out fiber portions 430 around the workpiece 500. In the temporary suspending step, the length of the feeding path is increased by moving the pressing member 92 while causing the pressing member to press against each fed-out fiber portion 430, with the feeding of each fed-out fiber portion 430 from each fiber roll portion 412 being continued.

The FW apparatus 10 includes the bobbin control unit 106, the winding control unit 108, and the tension control unit 114. The winding control unit 108 controls the winding device 18 to stop (temporarily suspend) the operation of the winding device 18 in the middle of the winding of each of the fed-out fiber portions 430 around the workpiece 500. When the winding control unit 108 stops the operation of the winding device 18 in the middle of the winding, the bobbin control unit 106 controls the bobbin driving unit 12 to continue the feeding of each fed-out fiber portion 430 from each fiber roll portion 412. In addition, at the time of temporal suspending, the tension control unit 114 controls the tension applying device 20 to move the pressing member 92 while causing the pressing member to press against each of the fed-out fiber portions 430, thereby increasing the length of the feeding path.

According to such a method and configuration, the feeding of each of the fed-out fiber portions 430 from each of the fiber roll portions 412 is continued during the temporary suspending step. Accordingly, since each fiber roll portion 412 is not excessively tightened by each fed-out fiber portion 430 during the temporary suspending step, it is possible to suppress deformation of each fiber roll portion 412. Therefore, it is possible to eliminate the need for correcting the plurality of fiber roll portions 412 or replacing the plurality of bobbin members 400. Therefore, it is possible to suppress an increase in the time required for the filament winding and suppress an increase in the cost of the filament winding.

Furthermore, since the length of the feeding path is increased by moving the pressing member 92 in the temporary suspending step, it is possible to continuously apply an appropriate tension to each of the fed-out fiber portions 430. This makes it possible to prevent the fed-out fiber portions 430 wound around the workpiece 500 from loosening.

In the temporary suspending step, the pressing direction of the pressing member 92 against each of the fed-out fiber portions 430 is the gravity direction. In this case, the load acting on the pressing member 92 can be effectively reduced.

In the temporary suspending step, the movement speed of the pressing member 92 is increased as the feed speed of each of the fed-out fiber portions 430 from each of the fiber roll portions 412 is increased. In other words, the FW apparatus 10 includes the speed sensor 98 that detects the feed speed of each of the fed-out fiber portions 430 from each of the fiber roll portions 412. During the temporary suspending, the tension control unit 114 controls the tension applying device 20 to increase the movement speed of the pressing member 92 as the feed speed detected by the speed sensor 98 becomes higher.

With such a method or configuration, it is possible to effectively suppress fluctuation in the tension acting on each of the fed-out fiber portions 430 during the temporary suspending step.

In the temporary suspending step, the movement speed of the pressing member 92 is made slower as the load which the pressing member 92 receives from each of the fed-out fiber portions 430 is larger. In other words, the FW apparatus 10 includes the load sensor 100 that detects a load which the pressing member 92 receives from each of the fed-out fiber portions 430. In the temporary suspending step, the tension control unit 114 controls the tension applying device 20 to make the movement speed of the pressing member 92 slower as the load detected by the load sensor 100 is larger.

With such a method or configuration, it is possible to effectively suppress fluctuation in the tension acting on each of the fed-out fiber portions 430 during the temporary suspending step.

The feed speed of each of the fed-out fiber portions 430 in the temporary suspending step is slower than the feed speed of each of the fed-out fiber portions 430 that occurred immediately before the temporal suspending step. In other words, during the temporary suspending step, the bobbin control unit 106 controls each bobbin driving unit 12 to make the feed speed of each fed-out fiber portion 430 slower than the feed speed of each fed-out fiber portion 430 immediately before the temporary suspending.

With such a method or configuration, it is possible to prevent the feeding path of the fed-out fiber portion 430 from becoming too long in the temporary suspending step.

The FW method includes the winding resuming step of operating the winding device 18 to resume the winding of each of the fed-out fiber portions 430 around the workpiece 500 after the temporary suspending step. In the winding resuming step, the pressing member 92 is moved to the initial position while the pressing member pressing each of the fed-out fiber portions 430. In other words, after temporarily suspending the operation of the winding device 18 in the middle of the winding, the winding control unit 108 controls the winding device 18 to resume the winding of each of the fed-out fiber portions 430 around the workpiece 500. When the winding of each fed-out fiber portion 430 around the workpiece 500 is resumed, the tension control unit 114 controls the tension applying device 20 to move the pressing member 92 to the initial position with the pressing member pressing each fed-out fiber portion 430.

With such a method or configuration, it is possible to return the pressing member 92 to the initial position while applying an appropriate tension to each fed-out fiber portion 430.

The movement speed of the pressing member 92 in the winding resuming step is faster than the movement speed of the pressing member 92 in the temporary suspending step. In other words, when the winding of each of the fed-out fiber portions 430 around the workpiece 500 is resumed, the tension control unit 114 controls the tension applying device 20 to make the movement speed of the pressing member 92 faster than the movement speed of the pressing member 92 at the time of the temporary suspending.

With such a method or configuration, it is possible to efficiently wind each of the fed-out fiber portions 430 around the workpiece 500 in the winding resuming step.

In the winding resuming step, the feed speed of each of the fed-out fiber portions 430 is gradually increased. In other words, the bobbin control unit 106 controls the bobbin driving unit 12 to gradually increase the feed speed of each of the fed-out fiber portions 430 when the winding of each of the fed-out fiber portions 430 around the workpiece 500 is resumed.

With such a method or configuration, in the winding resuming step, it is possible to suppress the load acting on each fiber roll portion 412 from each fed-out fiber portion 430 as compared to a case where the feed speed of each fed-out fiber portion 430 is rapidly increased.

Figure 10:
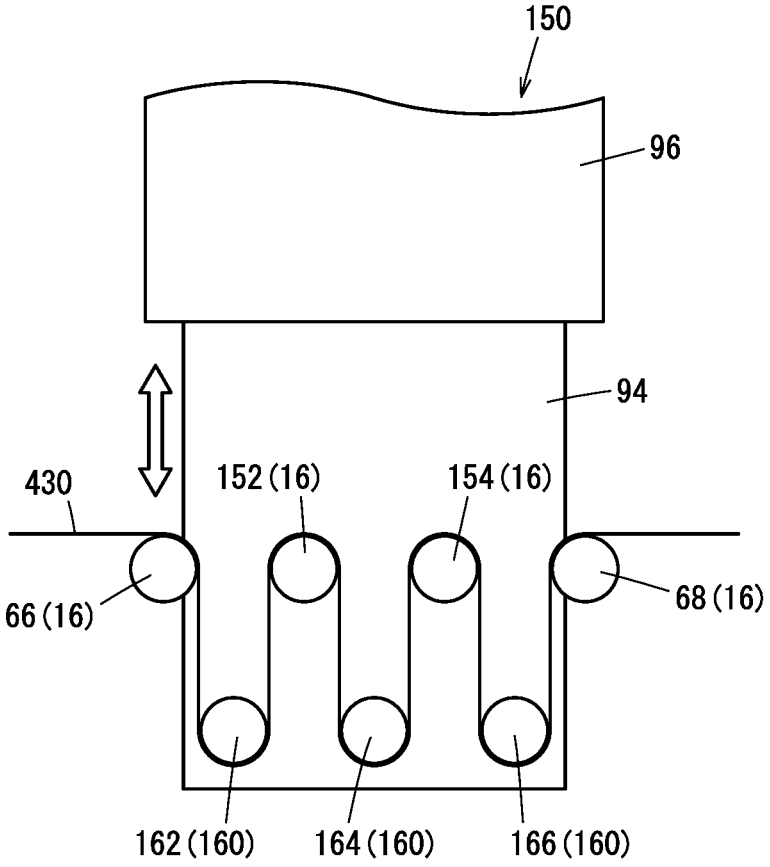
FIG. 10 is an explanatory plan view of a tension applying device according to a first modification.

The FW apparatus 10 may include a tension applying device 150 according to a first modification illustrated in FIG. 10 instead of the tension applying device 20 described above. In the first modification, the same reference numerals as those of the above-described embodiment denote the same components. Further, in the first modification, description of the same configuration as that of the above-described embodiment will be omitted.

When the tension applying device 150 is employed, as shown in FIG. 10, the plurality of feed rollers 16 further include a first intermediate roller 152 and a second intermediate roller 154. The first intermediate roller 152 is positioned between the second feed roller 66 and the third feed roller 68. The second intermediate roller 154 is located between the first intermediate roller 152 and the third feed roller 68. The second feed roller 66, the first intermediate roller 152, the second intermediate roller 154, and the third feed roller 68 are arranged in this order in the feeding direction of the plurality of fed-out fiber portions 430. The second feed roller 66, the first intermediate roller 152, the second intermediate roller 154, and the third feed roller 68 are arranged in a row in the horizontal direction.

The tension applying device 150 includes a plurality of pressing members 160, a pressing support member 94, and an actuator 96. The number of the pressing members 160 is three. However, the number of the plurality of pressing members 160 may be two or four or more. Each pressing member 160 is rotatably supported on the pressing support member 94. Each pressing member 160 is configured in the same manner as the pressing member 92 described above.

The plurality of pressing members 160 include a first pressing member 162, a second pressing member 164, and a third pressing member 166. The first pressing member 162 presses downward a portion of each of the fed-out fiber portions 430 that lies between the second feed roller 66 and the first intermediate roller 152. The second pressing member 164 presses downward a portion of each of the fed-out fiber portions 430 that lies between the first intermediate roller 152 and the second intermediate roller 154. The third pressing member 166 presses downward a portion of each of the fed-out fiber portions 430 that lies between the second intermediate roller 154 and the third feed roller 68.

The tension applying device 150 according to the first modification has effects similar to those of the tension applying device 20 described above. Further, the FW apparatus 10 including the tension applying device 150 has the following effects.

The FW apparatus 10 is provided with a plurality of feed rollers 16 for feeding each fed-out fiber portion 430 from the bobbin driving unit 12 to the winding device 18. The plurality of pressing members 160 are provided. At least one of the plurality of feed rollers 16 is disposed between the pressing members 160 adjacent to each other on the feeding path.

With such a configuration, it is possible to increase the maximum extension amount of the path of each fed-out fiber portion 430 while suppressing an increase in size of the FW apparatus 10.

Figure 11:
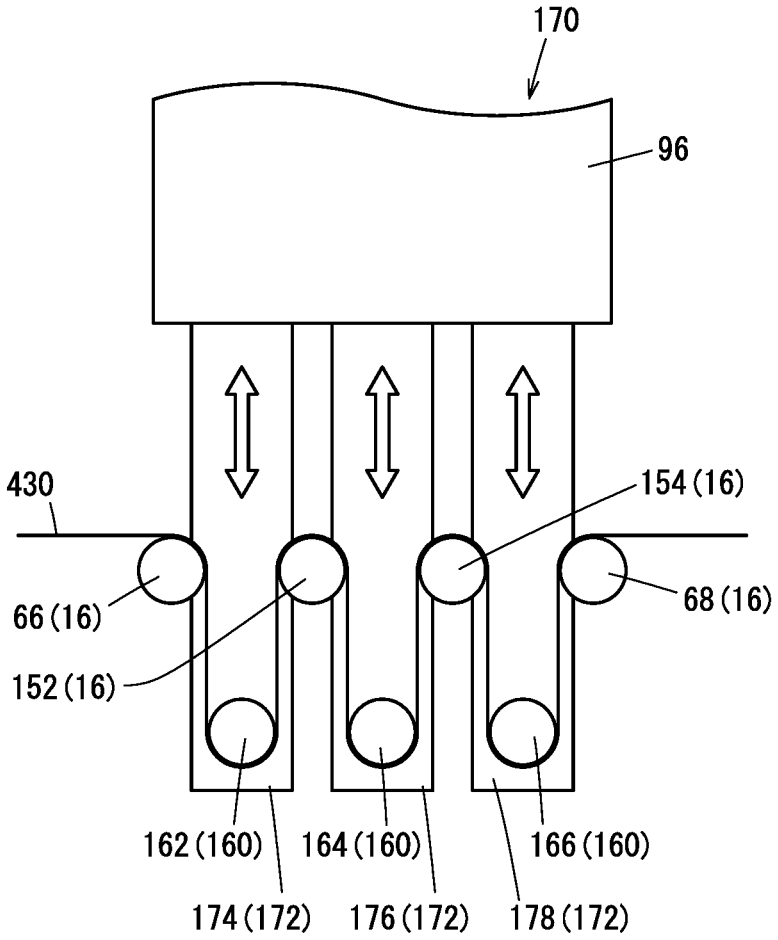
FIG. 11 is an explanatory plan view of a tension applying device according to a second modification.

The FW apparatus 10 may include a tension applying device 170 according to a second modification illustrated in FIG. 11 instead of the tension applying device 20 described above. In the second modification, the same reference numerals as those in the first modification denote the same configurations. Further, in the second modification, description of the same configuration as that of the first modification described above will be omitted.

As shown in FIG. 11, the tension applying device 170 includes a plurality of pressing members 160, a plurality of pressing support members 172, and an actuator 96. The number of the pressing support members 172 is the same as the number of the pressing members 160. That is, the number of the plurality of pressing support members 172 is three. The number of the pressing members 160 is three. The number of the plurality of pressing support members 172 and the number of the plurality of pressing members 160 each may be two or four or more.

The plurality of pressing support members 172 include a first pressing support member 174, a second pressing support member 176, and a third pressing support member 178. The first pressing member 162 is rotatably supported on the first pressing support member 174. The second pressing member 164 is rotatably supported on the second pressing support member 176. The third pressing member 166 is rotatably supported on the third pressing support member 178. The actuator 96 individually displaces the first pressing support member 174, the second pressing support member 176, and the third pressing support member 178 along the up-down direction.

The tension applying device 170 according to the second modification has effects similar to those of the tension applying device 20 described above. In addition, the tension applying device 170 according to the second modification has the same effect as the tension applying device 150 according to the first modification. Furthermore, according to the tension applying device 170, compared to the tension applying device 150, it is possible to finely adjust the length of the path of each fed-out fiber portion 430 in the temporary suspending step.

In the FW method using the above-described FW apparatus 10, the fiber bundle need not necessarily be impregnated with resin in advance. In this case, the FW apparatus 10 may include an impregnation device for impregnating the fiber bundle with the resin, on the path of the fed-out fiber portion 430.

The present invention is not limited to the above-described embodiment, and various configurations can be adopted therein without departing from the essence and gist of the present invention.

The embodiment described above can be summarized in the following manner.

According to the above embodiment, there is provided a filament winding method using a filament winding apparatus (10), wherein the filament winding apparatus includes: a bobbin driving unit (12) configured to rotate a bobbin member (400) including a bobbin (410) and a fiber roll portion (412) formed by winding a fiber bundle around the bobbin; a winding device (18) configured to wind a fed-out fiber portion (430) fed out from the fiber roll portion around a workpiece (500) in a state in which tension is applied to the fed-out fiber portion; and a tension applying device (20) provided in a feeding path of the fed-out fiber portion from the bobbin driving unit to the winding device, the tension applying device including a pressing member (92, 160) configured to press against the fed-out fiber portion, the filament winding method including: a suspending step of suspending operation of the winding device in a middle of winding the fed-out fiber portion around the workpiece. wherein in the temporarily suspending of the operation of the winding device, a length of the feeding path is increased by moving the pressing member while causing the pressing member to press against the fed-out fiber portion in a state of continuing to feed out the fed-out fiber portion from the fiber roll portion.

In the filament winding method, in the suspending step, a pressing direction of the pressing member against the fed-out fiber portion may be the direction of gravity.

In the filament winding method, in the temporary suspending step, the movement speed of the pressing member may be made higher as the feed speed of the fed-out fiber portion from the fiber roll portion becomes higher.

In the filament winding method, in the temporary suspending step, the movement speed of the pressing member may be made lower as a load received by the pressing member from the fed-out fiber portion becomes larger.

In the filament winding method, a feed speed of the fed-out fiber portion from the fiber roll portion in the temporary suspending step may be lower than a feed speed of the fed-out fiber portion from the fiber roll portion immediately before the temporary suspending step.

The filament winding method further may include: a winding resuming step of resuming the winding of the fed-out fiber portion around the workpiece by operating the winding device, after the temporary suspending step, and in the winding resuming step, the pressing member may be moved to an initial position while the pressing member is caused to press against the fed-out fiber portion.

In the filament winding method, a movement speed of the pressing member in the winding resuming step may be higher than a movement speed of the pressing member in the temporary suspending step.

In the filament winding method, in the winding resuming step, a feed speed of the fed-out fiber portion from the fiber roll portion may be gradually increased.

According to the above embodiment, there is provided a filament winding apparatus including: a bobbin driving unit configured to rotate a bobbin member including a bobbin and a fiber roll portion formed by winding a fiber bundle around the bobbin; a winding device configured to wind a fed-out fiber portion fed out from the fiber roll portion around a workpiece in a state in which tension is applied to the fed-out fiber portion; and a tension applying device provided in a feeding path of the fed-out fiber portion from the bobbin driving unit to the winding device, the tension applying device including a pressing member configured to press against the fed-out fiber portion; a bobbin control unit (106) configured to control the bobbin driving unit; a winding control unit (108) configured to control the winding device; and a tension control unit (114) configured to control the tension applying device, wherein the winding control unit controls the winding device to temporarily suspend operation of the winding device in a middle of winding of the fed-out fiber portion around the workpiece, and when the winding control unit temporarily suspends the operation of the winding device in the middle of the winding, the bobbin control unit controls the bobbin driving unit to continue to feed out the fed-out fiber portion from the fiber roll portion, and the tension control unit controls the tension applying device to move the pressing member while causing the pressing member to press against the fed-out fiber portion, thereby increasing a length of the feeding path.

In the above-described filament winding apparatus, in the temporarily suspending of the operation of the winding device, a pressing direction of the pressing member against the fed-out fiber portion may be the direction of gravity.

The filament winding apparatus may further include: a speed sensor (98) configured to detect a feed speed of the fed-out fiber portion fed out from the fiber roll portion, wherein in the temporarily suspending of the operation of the winding device, the tension control unit may control the tension applying device to increase a movement speed of the pressing member as the feed speed detected by the speed sensor becomes higher.

The filament winding apparatus may further include: a load sensor (100) configured to detect a load received by the pressing member from the fed-out fiber portion, wherein, in the temporarily suspending of the operation of the winding device, the tension control unit may control the tension applying device to make a movement speed of the pressing member lower as the load detected by the load sensor becomes larger.

In the above-described filament winding apparatus, in the temporarily suspending of the operation of the winding device, the bobbin control unit may control the bobbin driving unit so that a feed speed of the fed-out fiber portion from the fiber roll portion is lower than a feed speed of the fed-out fiber portion from the fiber roll portion immediately before the temporarily suspending of the operation of the winding device.

In the filament winding apparatus, the winding control unit may control the winding device to resume the winding of the fed-out fiber portion around the workpiece after temporarily suspending the operation of the winding device in the middle of the winding, and when the winding of the fed-out fiber portion around the workpiece is resumed, the tension control unit may control the tension applying device to move the pressing member to an initial position while causing the pressing member to press against the fed-out fiber portion.

In the filament winding apparatus, when the winding of the fed-out fiber portion around the workpiece is resumed, the tension control unit may control the tension applying device to make a movement speed of the pressing member higher than a movement speed of the pressing member at a time of temporarily suspending of the operation of the winding device.

In the filament winding apparatus, the bobbin control unit may control the bobbin driving unit to gradually increase the feed speed of the fed-out fiber portion from the fiber roll portion when the winding of the fed-out fiber portion around the workpiece is resumed.

The filament winding apparatus may further include: a plurality of feed rollers (16) configured to feed the fed-out fiber portion from the bobbin driving unit to the winding device, and the pressing member may include a plurality of pressing members, and at least one of the plurality of feed rollers may be disposed between the pressing members adjacent to each other on the feeding path.

What is claimed is:

1. A filament winding method using a filament winding apparatus, wherein the filament winding apparatus comprises:

a bobbin driving unit configured to rotate a bobbin member including a bobbin and a fiber roll portion formed by winding a fiber bundle around the bobbin;

a winding device configured to wind a fed-out fiber portion fed out from the fiber roll portion around a workpiece in a state in which tension is applied to the fed-out fiber portion; and a tension applying device provided in a feeding path of the fed-out fiber portion from the bobbin driving unit to the winding device, the tension applying device including a pressing member configured to press against the fed-out fiber portion, the filament winding method comprising:

temporarily suspending operation of the winding device in a middle of winding the fed-out fiber portion around the workpiece; and resuming the winding of the fed-out fiber portion around the workpiece by operating the winding device, after the temporarily suspending of the operation of the winding device, wherein in the temporarily suspending of the operation of the winding device, a length of the feeding path is increased by moving the pressing member while causing the pressing member to press against the fed-out fiber portion in a state of continuing to feed out the fed-out fiber portion from the fiber roll portion, throughout the temporarily suspending of the operation of the winding device, the fed-out fiber portion extends from the fiber roll portion to the workpiece, the fed-out fiber portion continues to be fed out from the fiber roll portion over the temporarily suspending to the resuming of the winding, throughout the temporarily suspending of the operation of the winding device, a movement speed of the pressing member is made higher as a feed speed of the fed-out fiber portion from the fiber roll portion becomes higher, and in the resuming of the winding, the pressing member is moved to an initial position while the pressing member is caused to press against the fed-out fiber portion.

2. The filament winding method according to claim 1, wherein in the temporarily suspending of the operation of the winding device, a pressing direction of the pressing member against the fed-out fiber portion is a direction of gravity.

3. The filament winding method according to claim 1, wherein a feed speed of the fed-out fiber portion from the fiber roll portion in the temporarily suspending of the operation of the winding device is lower than a feed speed of the fed-out fiber portion from the fiber roll portion immediately before the temporarily suspending of the operation of the winding device.

4. The filament winding method according to claim 1, wherein a movement speed of the pressing member in the resuming of the winding is higher than a movement speed of the pressing member in the temporarily suspending of the operation of the winding device.

5. The filament winding method according to claim 4, wherein in the resuming of the winding, a feed speed of the fed-out fiber portion from the fiber roll portion is gradually increased.

6. A filament winding method using a filament winding apparatus, wherein the filament winding apparatus comprises:

a bobbin driving unit configured to rotate a bobbin member including a bobbin and a fiber roll portion formed by winding a fiber bundle around the bobbin;

a winding device configured to wind a fed-out fiber portion fed out from the fiber roll portion around a workpiece in a state in which tension is applied to the fed-out fiber portion; and a tension applying device provided in a feeding path of the fed-out fiber portion from the bobbin driving unit to the winding device, the tension applying device including a pressing member configured to press against the fed-out fiber portion, the filament winding method comprising:

temporarily suspending operation of the winding device in a middle of winding the fed-out fiber portion around the workpiece; and resuming the winding of the fed-out fiber portion around the workpiece by operating the winding device, after the temporarily suspending of the operation of the winding device, wherein in the temporarily suspending of the operation of the winding device, a length of the feeding path is increased by moving the pressing member while causing the pressing member to press against the fed-out fiber portion in a state of continuing to feed out the fed-out fiber portion from the fiber roll portion, in the temporarily suspending of the operation of the winding device, the fed-out fiber portion extends from the fiber roll portion to the workpiece, the fed-out fiber portion continues to be fed out from the fiber roll portion over the temporarily suspending to the resuming of the winding, in the temporarily suspending of the operation of the winding device, a movement speed of the pressing member is made lower as a load received by the pressing member from the fed-out fiber portion becomes larger, and in the resuming of the winding, the pressing member is moved to an initial position while the pressing member is caused to press against the fed-out fiber portion.

7. A filament winding apparatus comprising:

a bobbin driving unit configured to rotate a bobbin member including a bobbin and a fiber roll portion formed by winding a fiber bundle around the bobbin;

a winding device configured to wind a fed-out fiber portion fed out from the fiber roll portion around a workpiece in a state in which tension is applied to the fed-out fiber portion;

a tension applying device provided in a feeding path of the fed-out fiber portion from the bobbin driving unit to the winding device, the tension applying device including a pressing member configured to press against the fed-out fiber portion; and a speed sensor configured to detect a feed speed of the fed-out fiber portion fed out from the fiber roll portion, wherein the filament winding apparatus further comprises one or more processors that execute computer-executable instructions stored in a memory, wherein the one or more processors execute the computer-executable instructions to cause the filament winding apparatus to:

control the bobbin driving unit;

control the winding device; and control the tension applying device, and the one or more processors cause the filament winding apparatus to:

control the winding device to temporarily suspend operation of the winding device in a middle of winding of the fed-out fiber portion around the workpiece;

control the winding device to resume the winding of the fed-out fiber portion around the workpiece after temporarily suspending the operation of the winding device in the middle of the winding;

when temporarily suspending the operation of the winding device in the middle of the winding, control the bobbin driving unit to continue to feed out the fed-out fiber portion from the fiber roll portion, and control the tension applying device to move the pressing member while causing the pressing member to press against the fed-out fiber portion, thereby increasing a length of the feeding path;

continue to feed out the fed-out fiber portion from the fiber roll portion over the temporarily suspending to the resuming of the winding;

throughout the temporarily suspending of the operation of the winding device, the one or more processors cause the filament winding apparatus to control the tension applying device to increase a movement speed of the pressing member as the feed speed detected by the speed sensor becomes higher, throughout the temporarily suspending of the operation of the winding device, the fed-out fiber portion extends from the fiber roll portion to the workpiece, and the one or more processors cause the filament winding apparatus to control the tension applying device to move the pressing member to an initial position while causing the pressing member to press against the fed-out fiber portion, when the winding of the fed-out fiber portion around the workpiece is resumed.

8. The filament winding apparatus according to claim 7, wherein in the temporarily suspending of the operation of the winding device, a pressing direction of the pressing member against the fed-out fiber portion is a direction of gravity.

9. The filament winding apparatus according to claim 7, wherein in the temporarily suspending of the operation of the winding device, the one or more processors cause the filament winding apparatus to control the bobbin driving unit so that a feed speed of the fed-out fiber portion from the fiber roll portion is lower than a feed speed of the fed-out fiber portion from the fiber roll portion immediately before the temporarily suspending of the operation of the winding device.

10. The filament winding apparatus according to claim 7, wherein when the winding of the fed-out fiber portion around the workpiece is resumed, the one or more processors cause the filament winding apparatus to control the tension applying device to make a movement speed of the pressing member higher than a movement speed of the pressing member at a time of temporarily suspending of the operation of the winding device.

11. The filament winding apparatus according to claim 10, wherein the one or more processors cause the filament winding apparatus to control the bobbin driving unit to gradually increase a feed speed of the fed-out fiber portion from the fiber roll portion when the winding of the fed-out fiber portion around the workpiece is resumed.

12. The filament winding apparatus according to claim 7, further comprising:

a plurality of feed rollers configured to feed the fed-out fiber portion from the bobbin driving unit to the winding device, wherein the pressing member comprises a plurality of pressing members, and at least one of the plurality of feed rollers is disposed between the plurality of pressing members adjacent to each other on the feeding path.

* * * * *